United States Patent [19]

Nitta

[11] 4,289,478

[45] Sep. 15, 1981

[54] CIGARET GAS LIGHTER

[75] Inventor: Tomio Nitta, Yokohama, Japan

[73] Assignee: Tokai Seiki Co., Ltd., Japan

[21] Appl. No.: 77,379

[22] Filed: Sep. 20, 1979

[30] Foreign Application Priority Data

Sep. 21, 1978 [JP] Japan ..... 53/116190

[51] Int. Cl.[3] ..... F23D 13/04; F23Q 2/08

[52] U.S. Cl. ..... 431/344; 431/130; 431/142

[58] Field of Search ..... 431/344, 130, 131, 142, 431/143, 150, 254, 255, 276, 277, 344

[56] References Cited

U.S. PATENT DOCUMENTS

| | | | |
|---|---|---|---|
| 3,096,636 | 7/1963 | Neinman | 431/344 |
| 3,523,558 | 8/1970 | Dupont | 431/344 |
| 3,663,152 | 5/1972 | Yoshida | 431/344 |
| 4,042,316 | 8/1977 | Rabe | 431/344 |
| 4,177,646 | 12/1979 | Guadagin et al. | 431/344 |

*Primary Examiner*—Samuel Scott
*Assistant Examiner*—Wesley S. Ratliff, Jr.

[57] ABSTRACT

In a cigaret gas lighter having a plastic gas tank and a burner mounted thereon, a heat collecting tube or rod is provided along the wick of the lighter hanging from the burner to the liquified fuel gas in the tank. The upper end of the heat collecting tube or rod is in direct contact with the lower surface of a pin disk located within the burner to effectively transmit heat to the pin disk that is disposed beneath the nozzle bottom in the burner.

3 Claims, 3 Drawing Figures

CIGARET GAS LIGHTER

BACKGROUND OF THE INVENTION

1. Field of the Invention

This invention relates to a disposable cigaret gas lighter, and more particularly to a plastic type disposable gas lighter in which the flare is stabilized.

2. Description of the Prior Art

In the disposable gas lighter or the like having a very simplified structure, which will hereinbelow be referred to simply as "lighter", most of the parts are made of plastic to save the manufacturing cost. In the upper part of the fuel gas tank, even the part around the burner is also made of plastic. Therefore, the heat of vaporization required for vaporizing the liquified fuel gas in the burner is not supplied to the burner sufficiently. This results in instable burning of the gas caused by incomplete vaporization of the liquified fuel gas passing through the burner.

The instable burning of the liquified gas results in instable flare the length of which changes with a short period, which not only is inconvenient in practical use of the lighter but also embarrasses the checker who checks the length of the flare in the process of the lighter manufacture. The instable flare makes it difficult or impossible, therefore, to measure the length of the flare in an automatic production system.

In order to stabilize the flare of the lighter, it is necessary to supply sufficient heat of vaporization to the passage of the liquified fuel gas around the nozzle bottom. In more detail, it is necessary to supply sufficient heat of vaporization to the passage of the liquified fuel gas provided between the nozzle bottom of the burner and a pin disk located in the nozzle bottom to prevent the temperature therearound from rapidly falling. In order to prevent the rapid falling of the temperature around the bottom of the nozzle, it is possible to enclose the bottom of the nozzle of the burner with a metal casing having high thermal conductivity. This is, however, disadvantageous in that the cost of the manufacturing thereof is increased thereby and further it does not suitable for mass production.

SUMMARY OF THE INVENTION

Therefore, it is the primary object of the present invention to provide a cigaret gas lighter which can be manufactured at a low cost and has a stable flare.

Another object of the present invention is to provide a cigaret gas lighter which has a simple structure and is suitable for mass production.

Still another object of the present invention is to provide a cigaret gas lighter which has a stable flare with a small number of parts and accordingly can be assembled very easily.

The lighter in accordance with the present invention is characterized in that the heat of vaporization for vaporizing the liquified fuel gas is supplied to the pin disk located between the nozzle bottom and the burner casing by way of a metal heat collecting member provided along the wick of the lighter one end of which is in contact with the pin disk and the other of which is dipped in the liquified fuel gas within the gas tank. The metal heat collecting member may be a cylindrical member provided around the wick or a rod member provided within the wick.

In accordance with the present invention, sufficient amount of liquified fuel gas penetrates into between the wick and the heat collecting member and accordingly the heat for vaporization is sufficiently supplied to the pin disk by way of the heat collecting member. Further, the liquified gas also penetrates between the inside face of the upper part of the gas tank through which the wick and the heat collecting member extend and the outside face of the heat collecting member or the wick, so that the heat of vaporization transmits therethrough, too.

Further, since the upper end of the heat collecting member is in direct contact with the lower face of the pin disk, the heat is effectively transmitted through the heat collecting member and the pin disk. By controlling the surface roughness of the upper end surface of the heat collecting member and the lower surface of the pin disk both made of metal, it is possible to control the flow rate of the liquified fuel gas whereby it is made possible to eliminate the flow control filter disposed between the pin disk and the bottom of the burner casing in the upper part of the gas tank. This results in reduction of the number of parts of the lighter as well as enhancement of the heat transmission through the heat collecting member and the pin disk.

DESCRIPTION OF THE PREFERRED EMBODIMENTS

Figure 1:
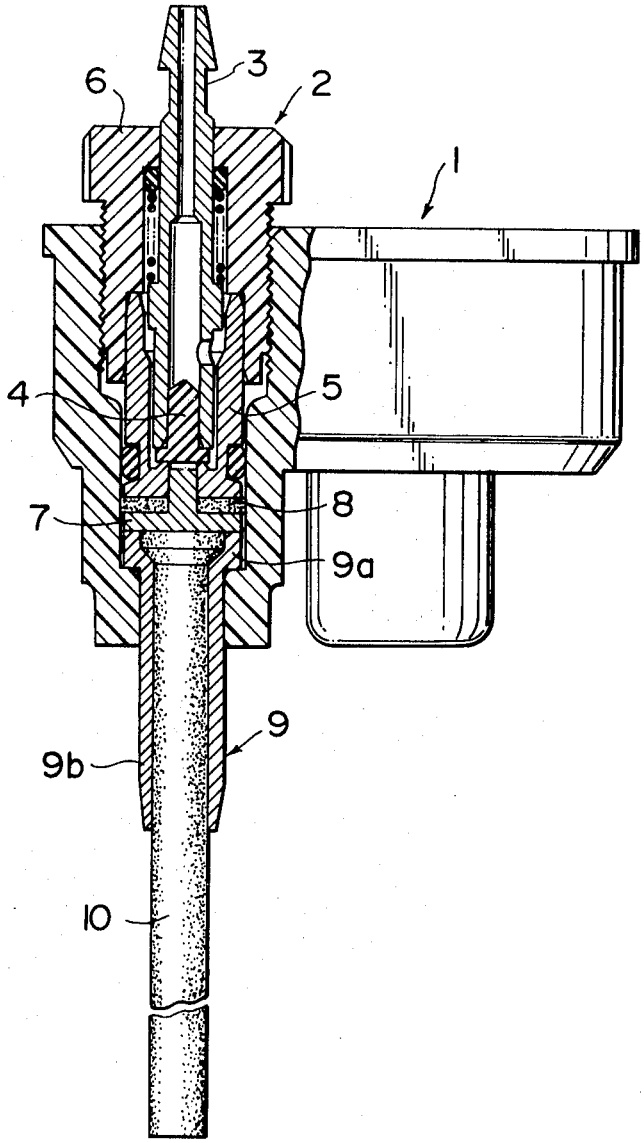
FIG. 1 is a partial vertical sectional view of a part of the lighter in accordance with an embodiment of the present invention.

Now an embodiment of the present invention will be described with reference to FIG. 1 which shows the upper part of the fuel gas tank 1 provided with a burner 2. The burner 2 includes a nozzle 3 the top of which is exposed above the tank 1, a nozzle bottom 5 which receives the lower part of the nozzle and is provided with a valve 4 interposed between the lower end of the nozzle 3 and the bottom thereof, a flare control nozzle holding screw cap 6 which receives therein the upper part of the nozzle 3 and the upper part of the nozzle bottom 5 and is screwed into a hole provided on the gas tank 1, a pin disk 7 having a pin inserted into the bottom hole of the nozzle bottom 5, and a ring filter 8 interposed between the lower face of the nozzle bottom 5 and the upper face of the pin disk 7. The nozzle, the nozzle bottom and the pin disk are made of metal and the flare control nozzle holding screw cap 6 is made of plastic.

The above mentioned structure of the burner 2 is the same as that of the conventional lighter. Differently from the conventional lighter, the lighter of this invention is not provided with another filter disposed between the lower face of the pin disk 7 and the bottom of the burner receiving portion of the upper part of the lighter. In this embodiment of the invention, the lower face of the pin disk 7 is in direct contact with the upper end of a wick 10 and the upper end of a heat collecting metal tube element 9. In more detail, a flange portion of the heat collecting metal tube element 9 indicated at **9*a* is interposed between the bottom of the burner receiving portion and the lower face of the pin disk 7, and most of the tubular part 9***b* of the heat collecting metal tube element 9 extends downward around the wick 10 from the flange portion 9*a* to support the wick therein. As shown in FIG. 1, the upper end of the wick 10 is enlarged to be engaged within the flange portion 9*a* of the metal tube element 9.

In the lighter as described above, the liquified gas within the gas tank passes through the wick 10 upwardly and further passes between the upper end face of the heat collecting metal tube element 9 and the lower face of the pin disk 7 and advances upwards between the internal wall of the hole of the tank retaining the burner 2 and the periphery of the pin disk 7. The liquified fuel gas advancing upwards around the pin disk 7 penetrates into the ring filter 8 and passes therethrough up to the space between the pin of the pin disk inserted into the hole of the nozzle bottom 5 and the internal wall face of the hole of the nozzle bottom 5 and is vaporized therearound. The gas vaporized moves upwards through the nozzle 3 by way of the space between the valve 4 and the nozzle bottom 5 and is spouted out of the nozzle at the top thereof. With a spark provided therearound, ignition is made. When the liquified gas is vaporized, a large amount of heat of vaporization is taken away from around the burner and accordingly the temperature around the burner is rapidly lowered.

Figure 2:
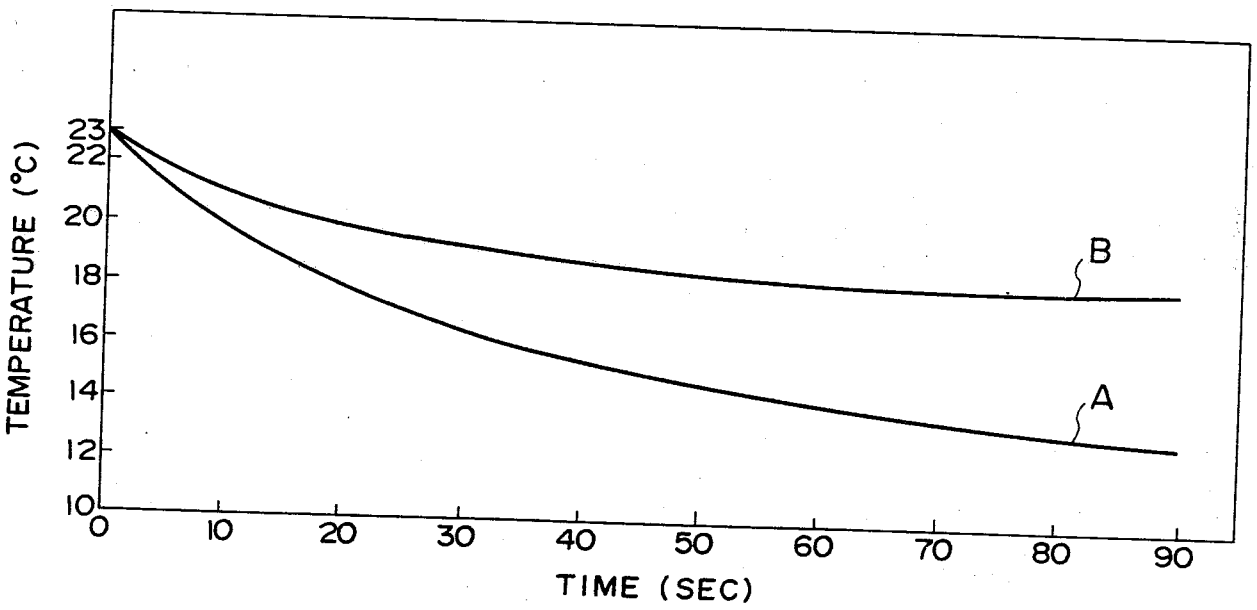
FIG. 2 is a graph showing the temperature fall of a part of the lighter concerned with the stability of the flare thereof.

FIG. 2 shows the temperature fall effected in accordance with the present invention in comparison with that of the conventional lighter. In the graph of FIG. 2 curve-A shows the temperature fall effected in the prior art lighter and curve-B shows that in this invention measured under the same condition. In the conventional lighter, the temperature of the nozzle bottom falls from 23° C. to 20° C. in less than 10 seconds. In this invention, on the other hand, the corresponding temperature falls from 23° C. to 20° C. taking more than 20 seconds. This shows that the temperature fall is small in this invention, which is caused by sufficient supply of heat to the nozzle bottom from other parts of the lighter.

Figure 3:
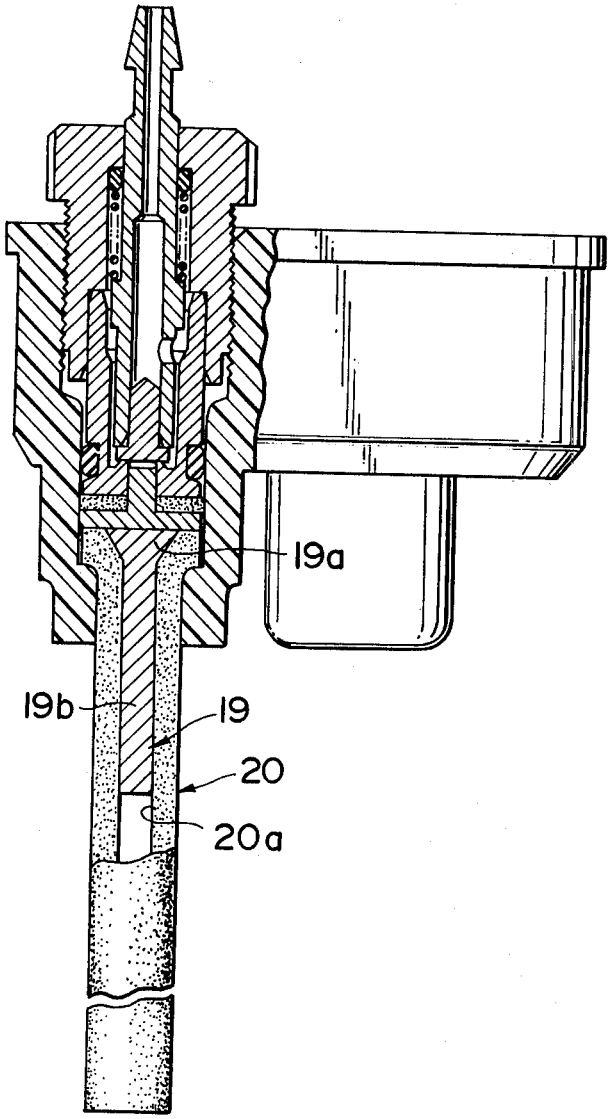
FIG. 3 is a partial vertical sectional view of a part of the lighter in accordance with another embodiment of the present invention.

FIG. 3 shows another embodiment of the present invention in which a heat collecting metal element 19 is provided within a tubular wick 20. As shown in FIG. 3, the wick 20 is a hollow tubular member having an enlarged diameter portion at the upper end thereof engaged with the lower part of the upper portion of the fuel tank 11 and a hollow portion 20*a* into which a metal rod 19 is inserted. The metal rod 19 has an enlarged diameter portion 19*a* at the upper end thereof and a slim portion 19*b* throughout its length and is inserted in said hollow portion 20*a* of the tubular wick 20.

I claim:

1. A cigarette gas lighter comprising a plastic fuel gas tank, a burner mounted on the plastic fuel gas tank, a nozzle bottom in said burner, a pin disk in said burner having a pin inserted into the nozzle bottom and a flat surface facing downwardly to the tank, a fuel take-up wick hung from the burner, said wick extending from said flat surface of the pin disk downwardly into a liquified fuel gas in the gas tank with an upper end of said wick held in direct contact with the flat surface of the pin disk, and a metal heat collecting member provided along the upper part of the wick with an upper end thereof held in direct contact with the flat surface of the pin disk and with the major portion thereof held in contact with the wick, whereby the heat of vaporization for vaporizing the liquified fuel gas is supplied to the burner by way of said metal member, and the upper ends of said wick and heat collecting member having downwardly extending tapered portions in engagement with each other to prevent relative movement therebetween.

2. A cigaret gas lighter as defined in claim 1 wherein said heat collecting metal member is a cylindrical metal element extending around the upper part of the wick.

3. A cigaret gas lighter as defined in claim 1 wherein said heat collecting metal member is a metal rod and said wick is a tubular member in which said metal rod is inserted in the upper part thereof.

* * * * *